US006223706B1

(12) United States Patent
Maas et al.

(10) Patent No.: US 6,223,706 B1
(45) Date of Patent: May 1, 2001

(54) TAPPET FOR THE VALVE GEAR OF AN INTERNAL COMBUSTION ENGINE

(75) Inventors: Gerhard Maas, Herzogenaurach; Oliver Schnell, Weisendorf, both of (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/509,342

(22) PCT Filed: Jun. 8, 1998

(86) PCT No.: PCT/EP98/03409

§ 371 Date: Mar. 24, 2000

§ 102(e) Date: Mar. 24, 2000

(87) PCT Pub. No.: WO99/17004

PCT Pub. Date: Apr. 8, 1999

(30) Foreign Application Priority Data

Sep. 27, 1997 (DE) ..... 197 42 777

(51) Int. Cl.[7] ..... F01L 13/00

(52) U.S. Cl. ..... 123/90.16; 123/90.48

(58) Field of Search ..... 123/90.15, 90.16, 123/90.17, 90.48, 90.5

(56) References Cited

U.S. PATENT DOCUMENTS 5,782,216 * 7/1998 Haas et al. ..... 123/90.16
5,950,583 * 9/1999 Kraxner et al. ..... 123/90.16

FOREIGN PATENT DOCUMENTS 196 22 174 6/1997 (DE) .
2162246 1/1986 (GB) .

* cited by examiner

*Primary Examiner*—Weilun Lo
(74) *Attorney, Agent, or Firm*—Bierman, Muserlian and Lucas

(57) ABSTRACT

A tappet (1) is designed to be coupled for different lifts of at least one gas exchange valve. It comprises an outer annular section (2) which concentrically encloses a circular section (3). Both sections (2, 3) are axially movable relative to each other and are loaded in the region of their bottoms (4, 5) by cams of different lifts. Slides (8, 9, 13) extend in receptions **(6*a*, 6*b*, 7) of the bottoms (4, 5). The first slide (8) cooperates with locking means (14) which scan a signal track on the opposing cam and, in a response to a lift of the signal track, block or permit a longitudinal movement of the first slide (8), the locking means yielding in their releasing direction under action of force. At the same time, the third slide (9) delimits on its radially outer end face (15), a pressure chamber for hydraulic medium. A displacement of all the slides (8, 9, 13) into their coupled position can be effected through this hydraulic medium. A particular advantage of the invention is that, on the one hand, the pressure chamber (16) for hydraulic medium is spatially separated from the locking means (14) so that no complicated sealing measures are required in the region of the locking means (14) because no hydraulic medium losses are to be expected. On the other hand, the locking means (14) are elastically mounted in cam-distal direction. They thus possess a certain yielding property for the event that due to the course of the signal track, the locking means (14) are prevented from taking their locking position on the first slide (8) by a section situated between locking recesses (24, 25) of the first slide (8)**.

11 Claims, 5 Drawing Sheets

TAPPET FOR THE VALVE GEAR OF AN INTERNAL COMBUSTION ENGINE

This application is a 371 of PCT/EP98/03409 filed Jun. 8, 1998.

FIELD OF THE INVENTION

The invention concerns a tappet for a valve train of an internal combustion engine, designed to be coupled for different lifts of at least one gas exchange valve and comprising an outer annular section which concentrically encloses a circular section which is axially movable relative to said annular section.

BACKGROUND OF THE INVENTION

A tappet of the pre-cited type is known from DE-OS 196 22 174. FIG. 8 of this document, for example, discloses a tappet having a coupling mechanism comprising in its annular section, two slides configured as pistons. Each of these pistons can be displaced toward the circular section by hydraulic means acting axially from the outside so that the entire tappet follows a lift of the cams which act on the annular section. To exclude switching errors, the outer cams possess a control contour that cooperates with locking means (balls) on the outer peripheral surface of the pistons. These pistons comprise axially spaced annular grooves. At the end of a base circle phase of the cams, the balls are displaced into these grooves by the control contour. An axial movement of the pistons is thus prevented.

A drawback of this prior art is that the locking means are situated in the region of the hydraulic medium supply to the pistons. This can result in hydraulic medium losses or make it problematic to implement sealing measures in this region. At the same time, due to their stiffness, these balls can get seated on an annular shoulder between the annular grooves of the pistons when a command to lock has been triggered by the control contour. This occurs when the pistons are not sufficiently displaced and can lead to a loading or even destruction of the component.

SUMMARY OF THE INVENTION

The object of the invention is therefore to create a tappet of the pre-cited type in which the mentioned drawbacks are eliminated and in which, more particularly, the locking means are spatially separated from the hydraulic medium supply to the slides, and, at the same time, to create locking means that yield in a cam-distal direction.

These and other objects and advantages of the invention will become obvious from the following detailed description.

A tappet switchable to different valve lifts is created in which switching errors of the slides are efficiently prevented. Due to the fact that the locking means are spatially separated from the prevailing hydraulic medium pressure for displacing the slides, the aforesaid hydraulic medium losses are no longer to be expected. At the same time, the transmitting members of the locking means are supported on a compression spring which urges the annular section in cam direction. In this way, a locking means is created that reliably yields in a cam-distal direction. A particular advantage of the invention is also that the transmitting members are situated outside of a reception for the associated slide.

The corresponding locking member is advantageously wedge-shaped in its region of engagement on the slide which comprises locking recesses of complementary shape to this wedge shape. Thus, in case of incomplete displacement, the first slide is moved into one of its end positions by wedge effect.

Due to the fact that the locking member is mounted on a compression spring which surrounds the circular section, a certain yielding of the locking member is achieved for the extremely rare case that a peak of the locking member and the annular shoulder situated between the annular grooves of the first slide come into confronting positions at a time when the signal track (control contour) is effecting a locking of the first slide. In place of the compression spring, it is also possible to provide a separate spring means for the locking means in axially parallel relationship to the tappet.

When pressure medium pressure decreases, the compression spring which biases the first slide toward the further receptions displaces this slide into a position immediately in front of an annular surface between the sections. The compression spring surrounding the second slide assures in a simple manner, a central positioning of the second slide because, in the switched-off state of the tappet, the annular section can execute such a large differential stroke relative to the circular section that the reception of the second slide is completely exposed. The second slide may comprise a ring to serve as an abutment surface for the second compression spring. This ring may extend, for instance, in a peripheral groove of the second slide. However, it is also possible to make the end coils of this compression spring with a smaller diameter and arrange them in an annular groove of the second slide.

The bores of the rings arranged in the receptions of the sections provide in a simple manner, slide ways for the slides so that an expensive finishing of the actual receptions in the sections is not required. The rings in the annular section can be used at the same time to provide axially outer closures for the receptions. The closure on the side of the first slide advantageously comprises an opening through which air displaced during a displacement of the first slide can escape. The closure of the second ring additionally serves to delimit a hydraulic medium chamber situated in front of the second slide. It is further proposed to stamp a region of a cylindrical wall of the ring for the second slide radially inwards. This forms an axial outer stop for the second slide in its reception.

It is proposed to equip the tappet with a hydraulic clearance compensation element. In this case, separate supplies of hydraulic medium to the slides and the clearance compensation element starting from inlets in the skirt of the tappet are provided. As seen in a top view of the tappet, a reservoir is arranged on one side next to each reception.

To act on the locking member configured as a pin, the signal track of the cam situated opposite thereto can be configured as a groove except for a first part of its base circle. When the recessed part of the signal track beginning with a second part of the base circle runs on the pin, this pin is simply pushed by the compression spring loading it into the groove. In this way, a displacement of the first slide is reliably prevented because the pin engages the opposing locking recess of the slide.

In place of the signal track configured as a groove, the first part of the base circle of the cam may also comprise an elevation protruding from the rest of the cam contour.

BRIEF DESCRIPTION OF THE DRAWINGS

The invention will now be described more closely with reference to the drawings which show.

DETAILED DESCRIPTION OF A PREFERRED EXAMPLE OF EMBODIMENT

Figure 1:
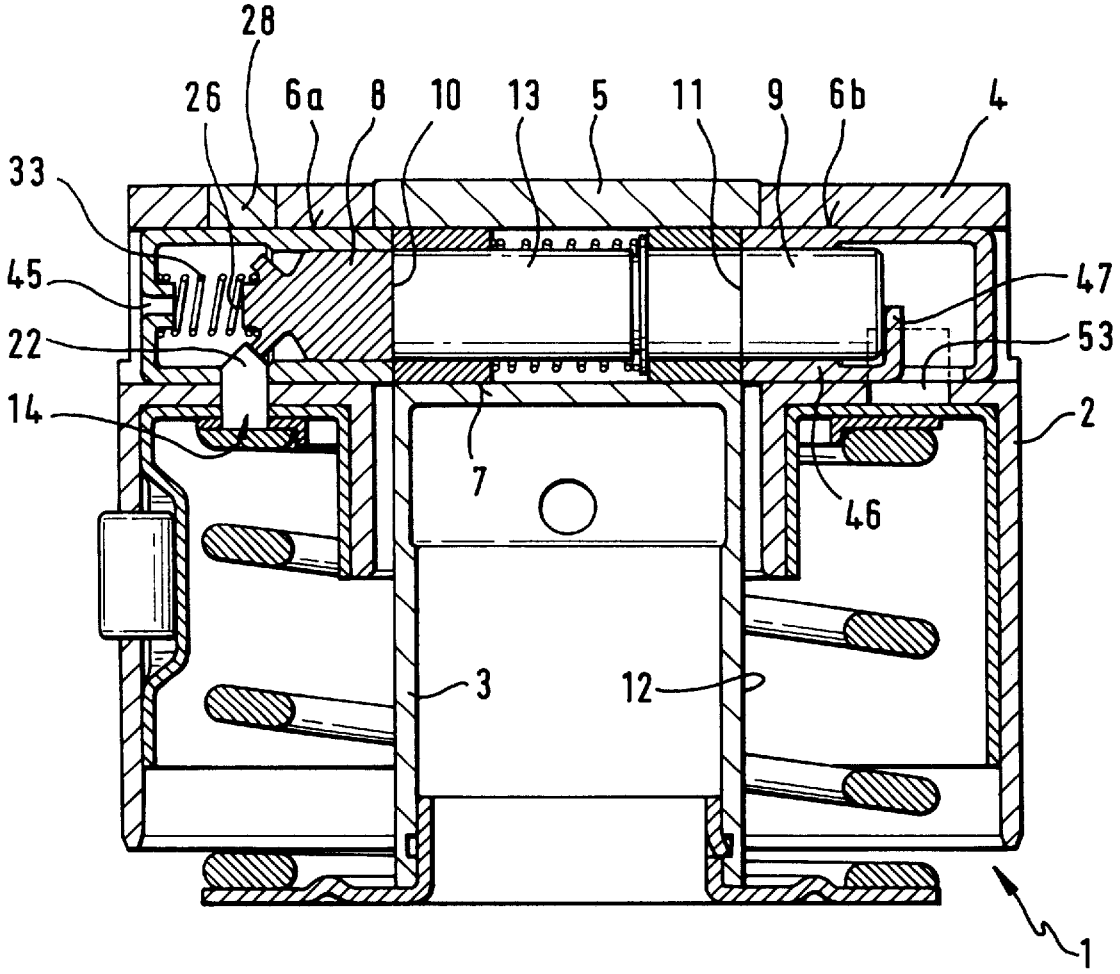
FIG. 1, a longitudinal section through a tappet according to the invention along line V—V of FIG. 4, the tappet being represented in its uncoupled state.
Figure 2:
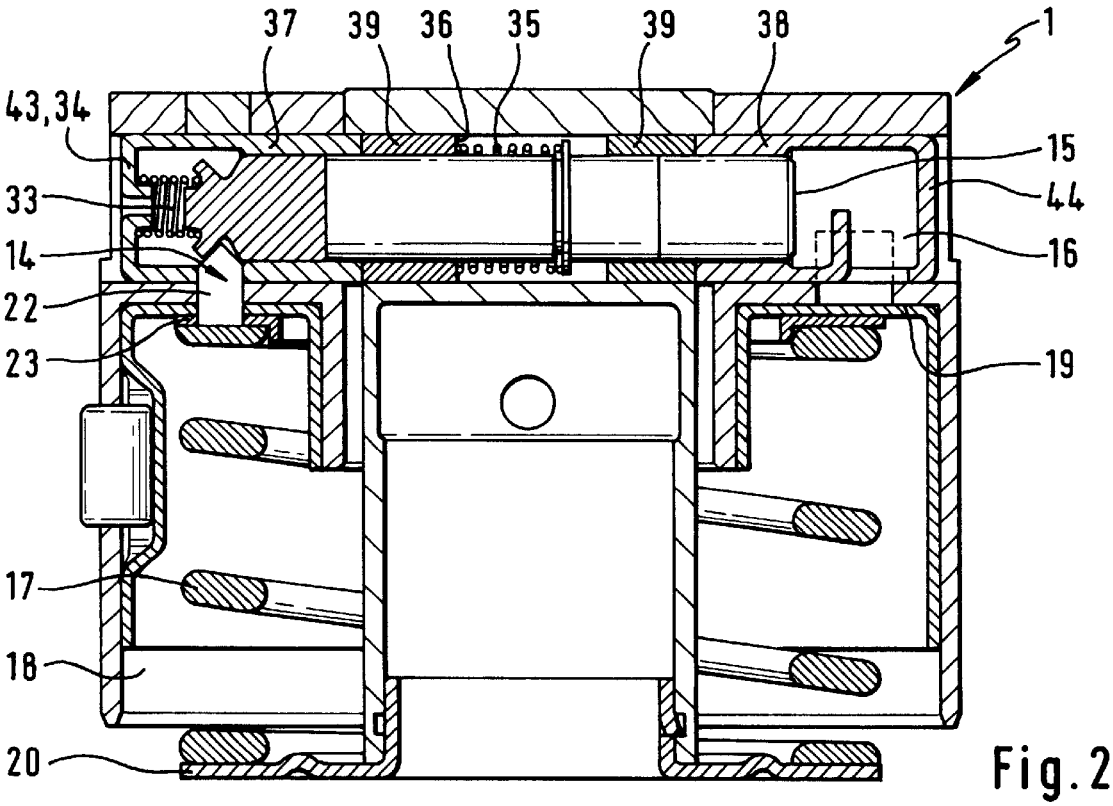
FIG. 2, a tappet according to FIG. 1, but in the coupled state.
Figure 3:
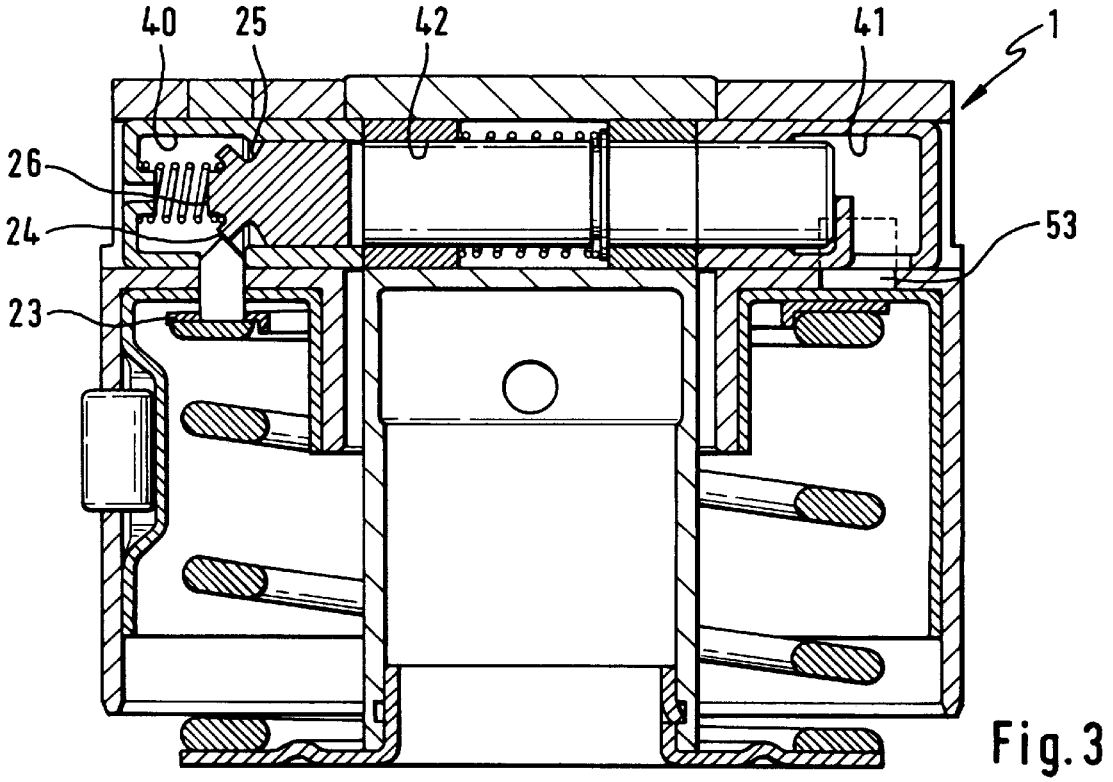
FIG. 3, a tappet as above, but with a not completely attained coupled position of the slides.

FIGS. 1–3 show a tappet 1 of a type known, per se, in the technical field. This tappet comprises an outer annular section 2 which encloses a circular section 3. Cams of different lifts (not shown) run on the bottoms 4, 5 of the sections 2, 3. Advantageously, the bottom 4 is contacted by two high lift cams and the bottom 5 by a low or zero lift cam. Receptions 6*a,* 6*b* and 7, that are aligned to one another in a base circle phase of the cams, are arranged within the bottoms 4, 5. A first slide 8 extends in the reception 6*a* and a third slide 9 extends in the reception 6*b*. As can be seen in FIG. 1, both these slides are situated in the uncoupled state of the tappet 1 directly in front of an annular surface 12 between the sections 2, 3. A second slide 13 is arranged in the reception 7 and extends over the entire axial length of its reception 7.

The first slide 8 is loaded on its axially outer end face 26 by a compression spring 33, while the second slide 13 is surrounded by a compression spring 35. This compression spring 35 is supported at one end on a shoulder 36 of a ring 39 extending directly in the reception 7. At its end facing the third slide 9, the compression spring 35 is connected to the second slide 13 by means that need no closer description in the present context. This compression spring 35 retains the second slide 13 in its central position.

Figure 4:
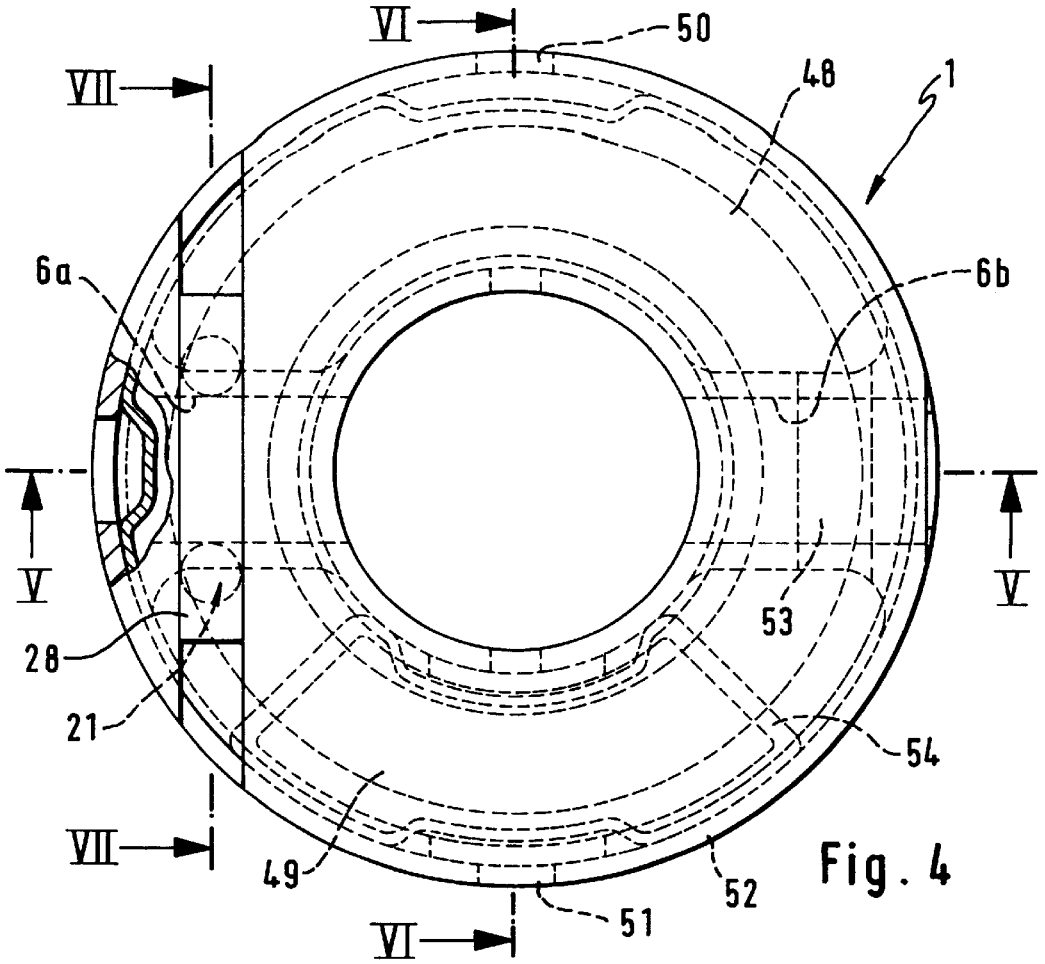
FIG. 4, a top view of a tappet according to the preceding figures.
Figure 5:
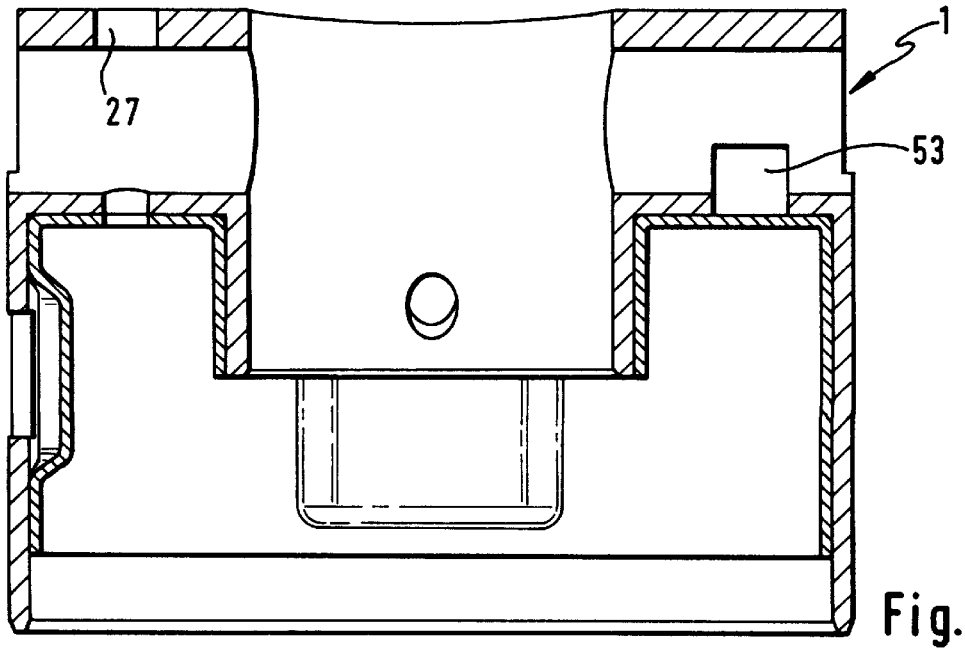
FIG. 5, a section along line V—V of FIG. 4 showing the tappet in the unassembled state.

Rings 37, 38 are likewise arranged in the receptions 6*a,* 6*b,* and the slides 6*a,* 6*b* extend directly in the bores 40, 41 of these rings. Axially outwardly, these rings 40, 41 comprise bottoms 43, 44 which close the receptions 6*a,* 6*b*. The bottom 43 comprises an opening 45 which permits an escape of the air displaced by the first slide 8 during its axial motion. The other bottom 44 delimits axially outwardly a pressure chamber 16 for hydraulic medium. This pressure chamber 16 is supplied with hydraulic medium from a reservoir 48 (see also FIGS. 4, 6) through an inlet 53.

At the same time, a cylindrical wall 46 of the ring 38 comprises a radially inwards stamped lug 47 which serves as an axial stop for the second slide 9 in outward direction. It goes without saying that this axial stop may also be formed by a separate component.

FIGS. 1 to 3 also show that the circular section 3 is surrounded by a compression spring 17. This acts with one end via a ring 23 on an undersurface 19 of the annular section 2. At its other end, the compression spring 17 is mounted on a support means 20. The main function of the compression spring 17 is to re-displace the annular section 2 into contact with the cams in the switched-off state of the tappet 1. In this embodiment, however, the compression spring 17 also serves another purpose to be described hereinafter.

As can be seen in FIGS. 1 to 3 and 4, 7, the slide 8 cooperates with locking means 14. These locking means 14 communicate with a signal track on a cam situated opposite the annular section 2. The locking means 14 mainly comprises two components, a transmitting member 21 and a locking member 22. The transmitting member 21 is configured as a pin 31, 32 and extends, as seen in a top view of the tappet 1, on both sides of the reception 6*a* in cam-distal direction. In the region of contact with the signal track, the locking means is made as a bridge 28 which, as seen in a top view of the tappet 1, intersects the reception 6*a* crosswise. The pins 31, 32 are fixed on ends 29, 30 of the bridge 28. At their cam-distal ends, the pins 31, 32 act on the above-mentioned ring 23. As seen in a top view of the tappet 1, the locking member 22 is disposed on the ring 23 under the reception 6*a*. This locking member 22 penetrates into the reception 6*a,* and at its end situated within the reception 6*a,* the locking member 22 has a wedge-like configuration.

At the same time, the first slide 8 comprises two axially spaced locking recesses 24, 25 which are complementary in shape to the wedge shape of the locking member 22. The end face 26 of the first slide 6*a* is utilized to form a part of the locking recess 24. The axial distance between the locking recesses 24, 25 corresponds to the desired displacement of the slides 8, 9,13.

FIG. 1, in particular, shows the tappet 1 in its switched-off state. This means that the slides 8, 9, 13 extend entirely in their receptions 6*a,* 6*b* and 7. It is only in a first part of a base circle of the contacting cam that the locking of the first slide 8 by the locking means 22 is released. Thus, a displacement, not shown, of the first slide 8 and of the other slides 9, 13 is only possible in this region.

FIG. 2 shows the tappet 1 in its switched-on state, i.e. the tappet executes a maximum stroke, while in FIG. 1, it only follows the lift contour of the cam contacting the bottom 5. It can be seen that the locking member 22 extends in the locking recess 25. At the same time, due to the hydraulic medium pressure prevailing in the pressure chamber 16, the slides 8, 9, 13 have been displaced from the right to the left. The position of the slides 8, 9, 13 and of the locking member 22 shown in FIG. 2 is reached directly at the beginning of the second part of the base circle of the contacting cam. Thus, all the slides 8, 9, 13 are prevented from any further displacements.

If the displacement of the slides 8, 9, 13 is insufficient, as illustrated in FIG. 3, the locking member 22 re-displaces the slides 8, 9, 13 by wedge effect at the beginning of the second part of the base circle into their uncoupled position. The release of the locking member 22 effected by the elevation of the first part of the base circle of the cam is thus terminated. The ring 23 which is loaded by the compression spring 17 pushes the locking member 22 in cam direction. If, contrary to all expectations, a peak of the locking member 22 should come to be situated opposite an annular shoulder between the locking recesses 24, 25, the locking member 22 can yield in cam-distal direction due to its spring-mounting. Thus, no excessive loading of components or their destruction takes place.

Due to the fact that the pressure chamber 16 for hydraulic medium is spatially separated from the locking means 14, it is not necessary to implement complicated sealing measures. Losses of hydraulic medium are not to be expected.

Figure 6:
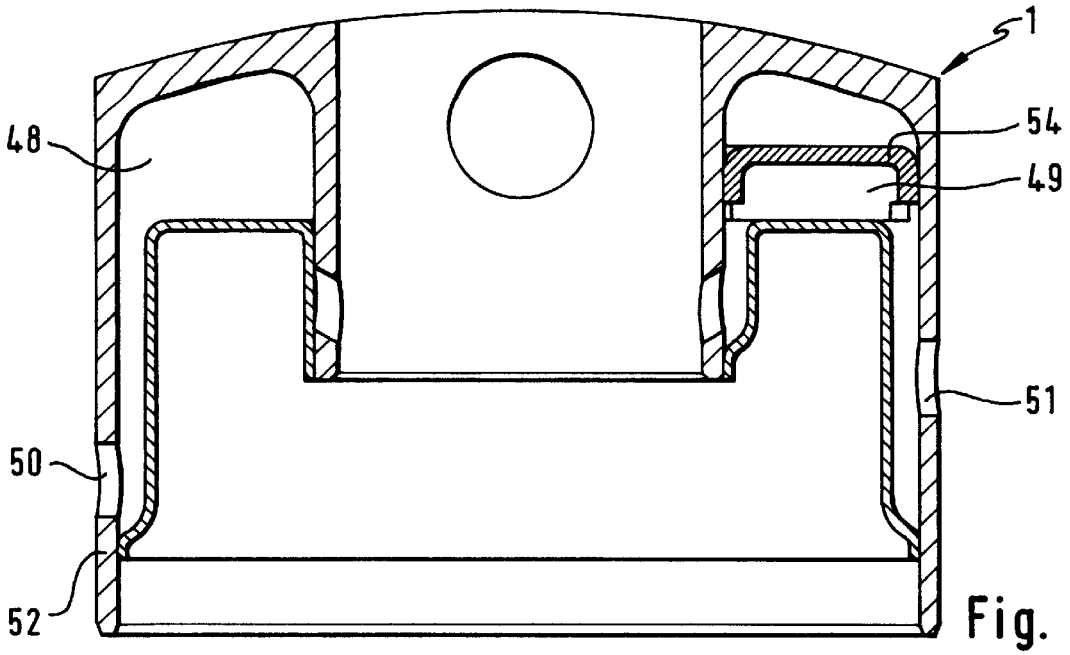
FIG. 6, a section along line VI—VI of FIG. 4 showing views of the reservoirs.
Figure 7:
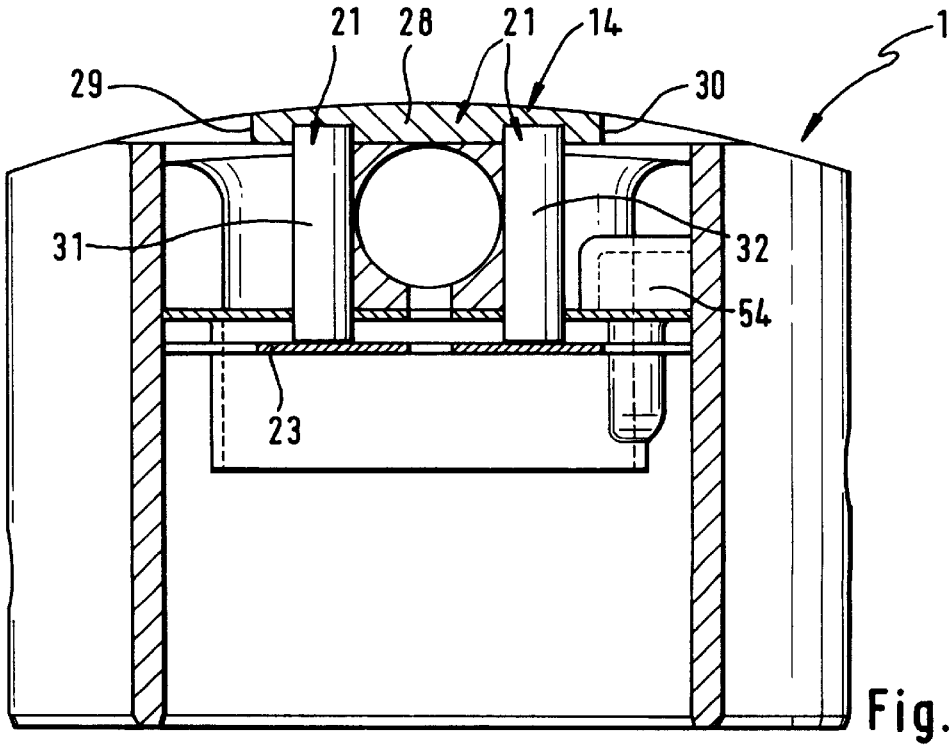
FIG. 7, a section along the secant-like line VII—VII of FIG. 4 with a detailed representation of the locking means.

FIG. 6 shows that two separate inlets 50, 51 for hydraulic medium are provided in the skirt 52 of the tappet 1. Hydraulic medium from the inlet 50 is fed into a reservoir 48 (see also FIG. 4). From this reservoir 48, the hydraulic medium is then transferred through the inlet 53 (see FIG. 1) into the pressure chamber 16 in front of a radially outer end face 15 of the third slide 9. A passage for the hydraulic medium leading to the reservoir 49 starts from the inlet 51. To achieve a complete hydraulic separation of this reservoir 49 from the reservoir 48, a cap 54 having the shape of a segment of a circle is arranged therein. The hydraulic medium can be conducted from the reservoir 49 to the hydraulic clearance compensation element installed in the circular section 3.

Figure 8:
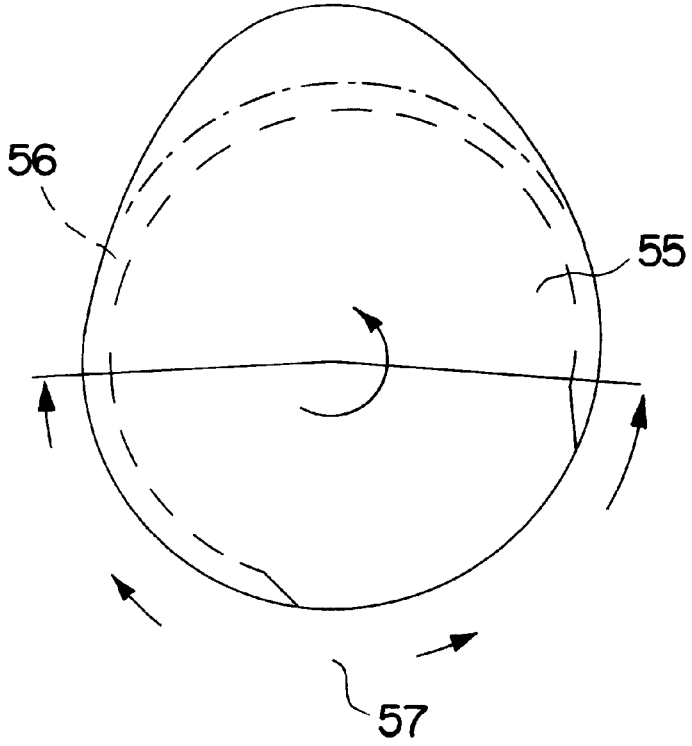
FIG. 8 is a cross-section of the outer cam with the signal tracks.
Figure 9:
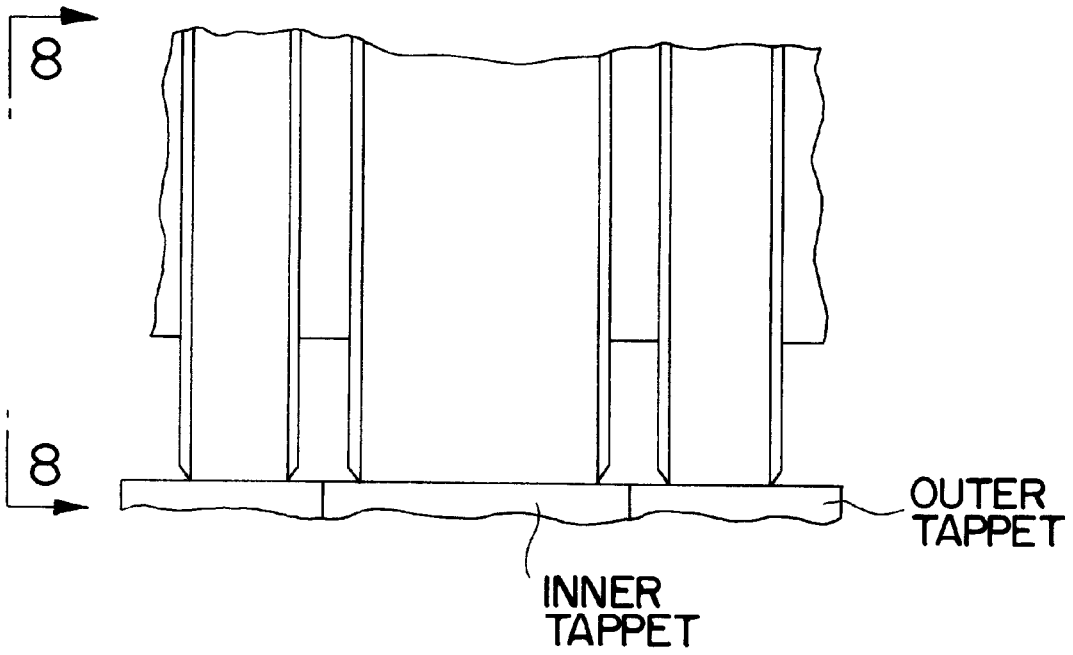
FIG. 9 is an illustration of the cams.

FIG. 8 shows the cam 55 with the signal track 56 which is configured as a groove except for the first of the base circle 57. FIG. 9 illustrates the cams at their base circle wherein the inner cam has a smaller lobe facing the bottom of the inner tappet. The outer cams contact the outer tappet as described in the summary of the invention.

What is claimed is:

1. Valve train of an internal combustion engine comprising a tappet (1) that can be coupled for different valve lifts of at least one gas exchange valve, said tappet (1) comprising an outer annular section (2) which concentrically surrounds a circular section (3) which is axially movable relative thereto, said sections (2, 3) are contacted in the region of their bottoms (4, 5) by cams of different lifts having at lest one signal track, or said annular section (2) is contacted in the region of its bottom (4) by at least one cam having a signal track, said sections (2, 3) comprising within their bottoms (4, 5) or in adjoining regions, at least one reception **(6*a*, 6*b*, 7) arranged radially and aligned to each other in the base circle phase of the cams, a first and a third slide (8, 9) being disposed in said receptions (6*a*, 6*b*) of the annular section (2), said slides (8, 9) extending in the uncoupled state of the tappet (1) with their radially inner end faces (10, 11) immediately in front of an annular surface (12) between the sections (2, 3), a second slide (13) extending in the uncoupled state of the tappet (1) over an entire length of the reception (7) of the circular section (3), the third slide (9) delimiting with its radially outer end face (15), a pressure chamber (16) for hydraulic medium, and locking means (14) for the slides (8, 9, 13) being associated to the tappet (1), said locking means (14) cooperate with the signal track on the opposing cam, wherein the first slide (8) is loaded on its radially outer end face by a compression spring (33) and cooperates with the locking means (14) which comprise a transmitting member (21) and a locking member (22), said locking member (22) penetrating in cam direction into a respective one of the receptions (6*a*) while being arranged axially below this reception (6*a*) on a ring (23) supported on a compression spring (17) which extends in an annular chamber (18) of the annular section (2) axially below the respective receptions (6*a*, 6*b*) and acts at the other end, on a support means (20) connected to the circular section (3), the transmitting member (21) extends on one or on both sides of the reception (6*a*) exteriorly thereof and parallel to the longitudinal axis of the tappet (1) and scans the signal track of the opposing cam with one end while acting with the other end on the ring (23), and the first slide (8) comprises, at least on a side facing the locking means (22), two locking recesses (24, 25) for the locking member (22), said locking recesses being spaced from each other at a distance corresponding to coupling and uncoupling positions of the slides (8, 9, 13)**.

2. Valve train according to claim 1, wherein the radially outer locking recess (24) is formed by a radially outer end face (26) of the first slide (8).

3. Valve train according to claim 1, wherein a region of the bottom (4) situated axially above the reception **(6*a*) comprises a recess (27) which is open in cam direction and extends transversely of the reception (6*a*), the transmitting member (21) is configured in the form of a bridge (28) which is arranged in the recess (27) and comprises, at one or both ends (29, 30), a pin (31, 32) that acts on the ring (23)**.

4. Valve train according to claim 1, wherein the locking member (22) tapers in a wedge shape in cam direction and the locking recesses (24, 25) of the first slide (8) are complementary in shape to the wedge shape.

5. Valve train according to claim 1, wherein the second slide (13) is fixed in a central position by a compression spring (35) which, on the side of the first slide (8), abuts against a shoulder (36) of the reception (7) and is fixed on the other side on the second slide (13), the force of the compression spring (33) for the first slide (8) being clearly smaller than the force of the compression spring (35) for the second slide (13).

6. Valve train according to claim 1, wherein a ring (37, 38; 39) extends in each reception **(6*a*, 6*b*, 7), and each ring comprises a bore (40, 41, 42) which is configured as a direct slide way for the slides (8 9, 13), the rings (37, 38) for the first and the third slide (8, 9) possess, radially outwardly, a bottom (43, 44), the bottom (43) of the ring (37) for the first slide (8) forms a closure (34) on which the compression spring (33) for the first slide (8) is supported, and the bottom (44) of the ring (38) for the third slide (9) delimits the pressure chamber (16)**.

7. Valve train according to claim 6, wherein the ring (38) of the third slide (9) comprises on its cylindrical wall (46), a radially inward stamped lug (47) for a transfer of hydraulic medium.

8. Valve train according to claim 7, wherein the lug (47) is configured at the same time as a radially outwardly acting stop for the third slide (9).

9. Valve train according to claim 6, wherein the bottom (43) of the ring (37) for the first slide (8) comprises an opening (45).

10. Valve train according to claim 1, wherein, as seen in a top view of the tappet (1), one reservoir (48, 49) for hydraulic medium extends on each side of the receptions **(6*a*, 6*b*) of the annular section (2), a first reservoir (48) serving to feed the pressure chamber (16), and a second reservoir (49) serving to feed a hydraulic clearance compensation element installed in the circular section (3), the reservoirs (48, 49) being supplied with hydraulic medium through separate inlets (50, 51) through a skirt (52) of the annular section (2)**.

11. Valve train according to claim 1, wherein, as seen in the direction of rotation of the cam, the signal track of the cam is divided in the base circle into two parts, a first part being raised relative to the second part so that when the locking means (14) runs on the first part, the first slide (8) is released and when the locking means (14) runs on the second part, or on the second part and on a following third part of a cam run-on flank, the first slide (14) is locked.

* * * * *